US005180636A

United States Patent [19]

Harazoe et al.

[11] Patent Number: 5,180,636

[45] Date of Patent: Jan. 19, 1993

[54] ROPE FOR TRACTION

[75] Inventors: Hirofumi Harazoe, Kugagun; Hiroyoshi Shiromoto, Iwakuni; Kazuo Yagi, Ootake; Masahiro Kouya, Iwakuni, all of Japan

[73] Assignee: Mitsui Petrochemical Industries Ltd., Tokyo, Japan

[21] Appl. No.: 680,616

[22] Filed: Apr. 2, 1991

Related U.S. Application Data

[63] Continuation of Ser. No. 241,870, Sep. 8, 1988, abandoned.

[30] Foreign Application Priority Data

Sep. 8, 1987 [JP] Japan ..... 62-225652
Apr. 4, 1988 [JP] Japan ..... 63-82502

[51] Int. Cl.[5] ..... D02G 3/00

[52] U.S. Cl. ..... 428/373; 428/375; 428/377; 428/364; 264/210.6

[58] Field of Search ..... 428/364, 373, 377, 375; 87/6; 264/210.6

[56] References Cited

U.S. PATENT DOCUMENTS

| | | | |
|---|---|---|---|
| 2,979,982 | 4/1961 | Weitzel | 87/6 |
| 3,805,667 | 4/1974 | Orser | 87/6 |
| 4,170,921 | 10/1979 | Repass | 87/6 |
| 4,312,260 | 1/1982 | Morieras | 87/6 X |
| 4,413,110 | 11/1983 | Kavesh et al. | 524/108 X |
| 4,545,950 | 10/1985 | Motooka et al. | 264/210.6 |
| 4,563,392 | 1/1986 | Harpell | 428/378 X |
| 4,612,148 | 9/1986 | Motooka et al. | 264/210.6 |
| 4,681,792 | 7/1987 | Harpell et al. | 428/246 X |
| 4,737,402 | 4/1988 | Harpell et al. | 428/246 X |
| 4,790,850 | 12/1988 | Dunn et al. | 623/13 |
| 4,830,907 | 5/1989 | Sawyer et al. | 428/359 X |
| 5,055,248 | 10/1991 | Motooka et al. | 264/210.6 |

FOREIGN PATENT DOCUMENTS

| | | |
|---|---|---|
| 0115192 | 8/1984 | European Pat. Off. . |
| 0200547 | 5/1986 | European Pat. Off. . |
| 2576045 | 7/1986 | France . |
| 1012742 | 12/1965 | United Kingdom . |
| 2051667A | 1/1981 | United Kingdom . |

OTHER PUBLICATIONS

Japan Textile News, "Dyneema SK60–Properties and Applications of a New High Strength/High Modulus Fiber Part 2", No. 392, Jul. 1987, Japan pp. 83–85.

*Primary Examiner*—Patrick J. Ryan
*Assistant Examiner*—N. Edwards
*Attorney, Agent, or Firm*—Sherman and Shalloway

[57] ABSTRACT

A rope for traction of a double structure of a core member coated with a sheath member, in which said core member comprises a molecularly oriented shaped article of an ultrahigh molecular weight polyolefin, and said sheath member comprises a braid. The rope proposed herein is light in weight, floatable on water, easy to handle and excellent in safety to human bodies and weatherability.

4 Claims, 1 Drawing Sheet

ROPE FOR TRACTION

This application is a continuation of application Ser. No. 07/241,870, filed Sep. 8, 1988 is now abandoned.

TECHNICAL FIELD OF THE INVENTION

The present invention relates to a rope for traction. More particularly, it relates to a rope for traction of paragliders, water skies and the like which is excellent in light weight, safety to human bodies and weatherability.

BACKGROUND OF THE INVENTION

Metallic ropes and wires have been used for traction of paragliders, water skies and the like. However, because of their heavy weight the metallic ropes sink in water and it is not easy to handle them. Further, they pose problems in that due to their reduced elongation under tensile stress shocks upon traction directly affect the object being pulled which might be injured by a sudden shock, and that because of their poor shock-absorbing properties the ropes themselves might be injured and broken.

OBJECT OF THE INVENTION

The invention is to solve the problems associated with the prior art and an object of the invention is to provide a rope for traction which is light, floatable on water, easy to handle and excellent in safety to human bodies and weatherability.

SUMMARY OF THE INVENTION

A rope for traction according to the invention has a double structure of a core member coated with a sheath member, in which said core member comprises a molecularly oriented shaped article of an ultrahigh molecular weight polyolefin, and said sheath member comprises a braid.

The rope for traction according to the invention having a double structure of a core member coated with a sheath member, in which said core member comprises a strong and resilient molecularly oriented shaped article of an ultrahigh molecular weight polyolefin, and said sheath member comprises a braid, is floatable on water, easy to handle and excellent in safety to human bodies and weatherability.

Especially in a case of the rope according to the invention wherein the core member comprises a molecularly oriented shaped article of an ultrahigh molecular weight copolymer of ethylene and one or more alpha-olefin, the molecularly oriented shaped article has an increased elongation under load and an increased amount of energy until break as well as improved shock resistance and creep resistance, and in consequence, any sudden shock may be effectively absorbed by the core member without attacking the object being pulled and the rope is prevented from tearing.

DETAILED DESCRIPTION OF THE INVENTION

Figure 1:
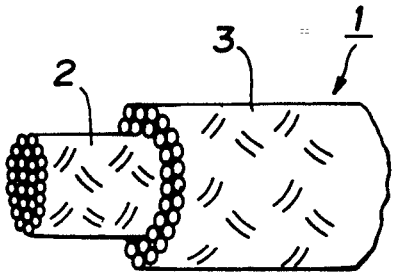

The invention will now be described in detail with reference to the attached drawing in which:

FIG. 1 is a partly cut out perspective view of a rope according to the invention.

As shown in FIG. 1, the rope 1 for traction according to the invention has a double structure comprising a core member 2 and a sheath member 3 enveloping the core member 2.

The core member 2 comprises a molecularly oriented shaped article of an ultrahigh molecular weight polyolefin.

The ultrahigh molecular weight polyolefin which can be used herein includes ultrahigh molecular weight homopolymers of ethylene or an alpha-olefin having from 3 to 20 carbon atoms such as ultrahigh molecular weight polyethylene, ultrahigh molecular weight polypropylene and ultrahigh molecular weigh poly-1-butene; ultrahigh molecular weight copolymers of at least two alpha-olefins having from 3 to 20 carbon atoms; and copolymers of ethylene and at least one alpha-olefin having from 3 to 20 carbon atoms, preferably from 4 to 10 carbon atoms such as ultrahigh molecular weight copolymer of ethylene and propylene, ultrahigh molecular weight copolymer of ethylene and 1-butene, ultrahigh molecular weight copolymer of ethylene and 4-methyl-1-pentene, ultrahigh molecular weight copolymer of ethylene and 1-hexene, ultrahigh molecular weight copolymer of ethylene and 1-octene and ultrahigh molecular weight copolymer of ethylene and 1-decene. Of these, the ultrahigh molecular weight copolymers of ethylene and at least one alpha-olefin mentioned above are particularly preferred. The alpha-olefin mentioned above is contained in the copolymer in an amout of from 0.1 to 20, preferably from 0.5 to 10, more preferably from 1 to 7 moecules on the average per 1000 carbon atoms of the copolymer.

The ultrahigh molecular weight polyolefin used herein has an intrinsic viscosity $[\eta]$ of at least 5 dl/g. By the term "ultrahigh molecular weight" is meant that the polyolefin has an intrinsic viscosity $[\eta]$ of at least 5 dl/g. Preferably, the polyolefin used herein has an intrinsic viscosity of from 7 to 30 dl/g.

Such an ultrahigh molecular weight polyolefin can be extruded and strongly drawn to provide a molecularly oriented shaped article such as filaments and tapes which article is light in weight, has increased elastic modulus and tensile strength, and is excellent in water and saline resistance. As described above, the ultrahigh molecular weight copolymer of ethylene and at least one alpha-olefin is particularly preferred for the purpose of the invention, since it can be extruded and strongly drawn at a draw ratio of from 5 to 80, preferably from 10 to 50 to a molecularly oriented shaped article having improved shock and creep resistances in addition to the above-mentioned combination of advantageous properties. Further, the molecularly oriented shaped article made from the ultrahigh molecular weight copolymer of ethylene and at least one alpha-olefin has an improved heat resistance.

The core member 2 of the rope in accordance with the invention comprises a molecularly oriented shaped article of an ultrahigh molecular weight polyolefin, preferably of an ultrahigh molecular weight copolymer of ethylene and at least one alpha-olefin having from 3 to 20 carbon atoms.

Although the molecularly oriented shaped article constituting the core member 2 is preferably a bundle of aligned drawn filaments or a braid of drawn filaments, it may be in the form of tapes or films drawn in at least one direction.

The molecularly oriented shaped article constituting the core member 2 has a density of from 0.940 to 0.990, and in particular from 0.960 to 0.985, as measured by a conventional density gradient tube method in accordance with ASTM D 1505 at a temperature of 23° C., using carbon tetrachloride and toluene in the density gradient tube.

The molecularly oriented shaped article used herein has a dielectric constant (1 KHz, 23° C.) of normally from 1.4 to 3.0, and preferably from 1.8 to 2.4, and a dielectric loss tangent (1 KHz, 80° C.) of from 0.050 to 0.008%, and preferably from 0.040 to 0.010%. The measurements of the dielectric constant and the dielectric loss tangent were carried out on molecularly oriented filaments and tapes compactly aligned in the form of films in accordance with ASTM D 150.

The degree of molecular orientation of the molecularly oriented shaped article may be determined by X-ray diffractometry, birefringence method or fluorescence polarization method. In the case of molecularly oriented filaments of the copolymer of ethylene and at least one alpha-olefin, it is desirable from a view point of their mechanical properties that they have a degree of molecular orientation (F) of at least 0.90, and preferably at least 0.95, as determined from the half-value width. Such a degree of molecular orientation is described in detail, for example by Yukichi GO and Ki-ichiro KUBO, in Kogyo Kagaku Zasshi (Journal of the Society of Industrial Chemistry of Japan), 39, 992 (1939), that is, it is defined by the following formula:

$$\text{Degree of Orientation (F)} = (90° - 0.5\ H°)/90°$$

wherein H is a half-value width (in °) of a strength distribution curve along the Debye ring on the strongest paratroop on the equator.

The molecularly oriented shaped article used herein has excellent mechanical properties. For example, it has, in the form of drawn filaments, an elastic modulus of at least 20 GPa, and in particular at least 30 GPa, and a tensile strength of at least 1.2 GPa, and in particular at least 1.5 GPa.

The molecularly oriented shaped article used herein has an impulse break down voltage of from 110 to 250 KV/mm, in particular from 150 to 220 KV/mm. The impulse break down voltage was measured on the same samples as employed in the measurement of the dielectric constant that was placed on a copper plate, the voltage of which was increased by applying thereto impulse of negative polarity at a rate of 2 KV/3 steps by means of a JIS-type bronze electrode having a diameter of 25 mm.

The molecularly oriented shaped article made of the above-mentioned ultrahigh molecular weight copolymer of ethylene and at least one alpha-olefin is remarkably excellent in shock resistance, breaking energy and creep resistance.

The molecularly oriented shaped article has a breaking energy of at least 8 kg.m/g, in particular at least 10 kg.m/g.

The molecularly oriented shaped article is excellent in creep resistance. In an accelerated test for creep at room temperature, that is, in a test for creep at elevated temperature, it exhibits a remarkably reduced creep. At a temperature of 70° C., and under a load of 30% of the breaking load, the molecularly oriented shaped article made of the above-mentioned ultrahigh molecular weight copolymer of ethylene and at least one alpha-olefin exhibits a creep elongation (% elongation after 90 sec.) of not more than 7%, and in particular not more than 5%, and a creep speed between after periods of 90 sec. and 270 sec. $\epsilon_{90-180}$ ($sec^{-1}$) of not faster than $4\times10^{-4}sec^{-1}$, and in particular not faster than $5\times10^{-5}sec^{-1}$, In addition to the above-described properties at room temperature, the molecularly oriented shaped article made of the copolymer of ethylene and at least one alpha-olefin has the following thermal properties.

Namely, it has at least one crystal fusion peak (Tp) at a temperature range at least 20° C. higher than the inherent crystal fusion temperature (Tm) of the copolymer and the fusion heat based on the crystal fusion peak (Tp) is at least 15%, preferably at least 20%, and more preferably at least 30%, based on the total fusion heat.

The inherent crystal fusion temperature (Tm) of the above-mentioned copolymer can be determined by a so-called second run in a differential scanning calorimeter, in which the molecularly oriented shaped article of the copolymer is once fused completely and cooled thereby moderating the molecular orientation, and thereafter heated again.

More particularly, with respect to the molecularly oriented shaped article of the above-mentioned copolymer, no crystal fusion peak appears in the above-mentioned inherent crystal fusion temperature range of the copolymer, or even if any peak is observed in this temperature range, it appears only as tailing. The crystal fusion peak (Tp) normally appears in a temperature range of from Tm+20° C. to Tm+50° C., and in particular in a temperature range of from Tm+20° C. to Tm+100° C., and it appears frequently in the form of a plurality of peaks in the above-mentioned temperature range. The crystal fusion peak (Tp) often appears in the form of two separate peaks, that is, a higher temperature fusion peak ($Tp_1$) in a temperature range of from Tm+35° C. to Tm+100° C., and a lower temperature fusion peak ($Tp_2$) in a temperature range of from Tm+20° C. to Tm+35° C. Depending upon the conditions of the preparation of the molecularly oriented shaped articles, the $Tp_1$ or $Tp_2$ comprises a plurality of peaks.

It is considered that the high crystal fusion peaks ($Tp_1$ *l and* $Tp_2$) prominently improve the heat resistance of the molecularly oriented shaped article of the ultrahigh molecular weight ethylene/α-olefin copolymer and contribute to maintenance of the strength retention ratio or elastic modulus retention ratio at a high level after a heat hysteresis at an elevated temperature.

It is preferred that the fusion heat based on the higher temperature fusion peak ($Tp_1$) in a temperature range of from Tm+35° C. to Tm+100° C. be at least 1.5%, especially at least 3.0%, based on the total fusion heat.

In the case where the fusion heat based on the higher temperature fusion peal ($Tp_1$) satisfies the above requirement, even if the higher temperature fusion peak ($Tp_1$) does not appear as a projecting main peak, that is, even if the peak ($Tp_1$) is an assemblage of small peaks or a broad peak, excellent creep resistance characteristics can be obtained though it sometimes happens that the heat resistance is somewhat degraded.

The melting point was measured using a differential scanning calorimeter (Model DSC II supplied by Perkin-Elmer Co.). About 3 mg of a sample was kept in the restraint state by winding the sample on an aluminium sheet having a size of 4 mm×4 mm×0.2 mm (thickness). Then, the sample wound on the aluminum sheet was sealed in an aluminum pan to be placed in a sample holder of a cell. An aluminum sheet equal to that used for the sample was sealed in an aluminum pan ordinarily kept vacant, to be placed in a reference holder of the cell, whereby a heat balance was kept. The cell was held at 30° C. for about 1 minute, and then, the temperature was elevated to 250 ° C. at a rate of 10° C./min. and the measurement of the melting point of the sample at the first temperature elevation was completed. Subsequently, the sample was held at 250° C. for 10 minutes. Then, the temperature was lowered at a rate of 20° C./min. and the sample was held at 30° C. for 10 minutes. Then, the temperature was elevated to 250° C. again at a rate of 10° C./min., and the measurement of the melting point at the second temperature elevation (second run) was completed. The maximum value of the fusion peak was designated as the melting point. When the peak appeared as a shoulder, tangential lines were drawn at the bending points on the low temperature side and high temperature side just close to the shoulder, and the intersection point was designated as the melting point.

A base line connecting points of 60° C. and 240° C. in the endothermic curve was drawn, and a vertical line was drawn at a point higher by 20° C. than the inherent crystal fusion temperature (Tm) of the copolymer determined as the main fusion peak at the second temperature elevation. A low temperature portion surrounded by these lines an area surrounded by the base line, vertical line and endothermic curve including the point of 60° C. was regarded as being based on the inherent crystal fusion (Tm) and the high temperature portion an area surrounded by the base line, vertical line and the endothermic curve including the point of 240° C. was regarded as being based on the crystal fusion (Tp) manifesting the functions of the molecularly oriented shaped article copolymer. The crystal fusion heats were calculated from areas of these portions. According to the above-mentioned method, the portion between vertical lines at Tm+20° C. and at Tm+35° C. was regarded as being based on the fusion of $Tp_2$ and the high temperature portion was regarded as being based on the fusion of $Tp_1$, and the heats based on the fusion of $Tp_1$, and the heats based on the fusion of $Tp_1$ and the fusion of $Tp_2$ were similarly calculated from the areas of these portions.

The molecularly oriented filaments of the above-mentioned ultrahigh molecular weight copolymer of ethylene and at least one alpha-olefin have a strength retention of at least 95%, and an elastic modulus retention of at least 90%, in particular at least 95%, after a heat hysteresis of 170° C., for a period of 5 minutes, indicating the fact that they have a prominently superior heat resistance which are not found in drawn filaments of ultrahigh molecular weight polyethylene.

Process for the preparation of a molecularly oriented shaped article of an ultrahigh molecular weight polyolefin Generally, a molecularly oriented shaped article having high elastic modulus and high strength can be prepared by extruding an ultrahigh molecular weight polyolefin into filaments, tape or the like and strongly drawing the exrudate. Such a process per se is known in the art.

For example, Japanese Patent Application Laid-Open Specification No. 15408/81 discloses a process comprising spinning a dilute solution of ultrahigh molecular weight polyethylene and drawing the obtained filaments. Japanese Patent Application Laid-Open Specification No. 130313/84 discloses a process comprising melt-kneading ultrahigh molecular weight polyethylene with a wax, extruding the kneaded mixture, cooling and solidifying the extrudate and drawing the solidified extrudate. Furthermore, Japanese Patent Application Laid-Open Specification No. 187614/84 discloses a process comprising extruding the above-mentioned melt-kneaded mixture, drafting the extrudate, then cooling and solidifying the extrudate and drawing the solidified extrudate.

A process for the preparation of a molecularly oriented shaped article of a preferred ultrahigh molecular weight polyolefin, that is, an ultrahigh molecular weight copolymer of ethylene and at least one alpha-olefin, will now be described in detail.

Preparation of the Copolymer

The ultrahigh molecular weight ethylene/α-olefin copolymer is obtained, for example, by slurry-polymerizing ethylene and at least one α-olefin having from 3 to 20, preferably from 4 to 10 carbon atoms in an organic solvent in the presence of a Ziegler catalyst.

Examples of the preferred α-olefin include, for example, butene-1, pentene-1, 4-methylpentene-1, hexene-1, heptene-1 and octene-1. Of these, 4-methyl-pentene-1, hexene-1 and octene-1 are particularly preferred. The α-olefin comonomer should be used in such an amount that the α-olefin content per 1000 carbon atoms in the polymer chain is within the above-mentioned range. Moreover, the ultrahigh molecular weight ethylene/α-olefin copolymer should have a molecular weight corresponding to the above-mentioned intrinsic viscosity [η].

In the ultrahigh molecular weight ethylene/α-olefin copolymer used herein, the determination of the α-olefin component is carried out using an infrared spectrophotometer (supplied by Nippon Bunko Kogyo). Namely, the absorbance at 1378 $cm^{-1}$, which indicates the deformation vibration of the methyl group of the α-olefin included in the ethylene chain, is measured, and the measured value is converted to the number of the methyl branches per 1000 carbon atoms using a calibration curve prepared in advance using a model compound in a $^{13}C$ nuclear magnetic resonance spectroscopy.

Preparation of the Molecularly Oriented shaped Article

Upon preparation of the molecularly oriented shaped article of the ultrahigh molecular weight ethylene/α-olefin copolymer, a diluent is incorporated in the copolymer. A solvent for the ultrahigh molecular weight ethylene copolymer or a wax having a compatibility with the ultrahigh molecular weight ethylene copolymer is used as the diluent.

A solvent having a boiling point higher, especially by at least 20° C., than the melting point of the above-mentioned copolymer is preferably used as the solvent.

As specific examples of the solvent, there can be mentioned aliphatic hydrocarbon solvents such as n-nonane, n-decane, n-undecane, n-dodecane, n-tetradecane, n-octadecane, liquid paraffin and kerosine, aromatic hydrocarbon solvents and hydrogenated products thereof such as xylene, naphthalene, tetralin, butylbenzene, p-cumene, cyclohexylbenzene, diethylbenzene, benzylbenzene, dodecylbenzene, bicylohexyl, decalin, methylnaphthalene and ethylnaphthalene, halogenated hydrocarbon solvents such as 1,1,2,2,-tetrachloroethane, pentachloroethane, hexachlorobenzene, 1,2,3-trichloropropane, dichlorobenzene, 1,2,4-trichlorobenzene and bromobenzene, and mineral oils such as paraffinic process oil, naphthenic process oil and aromatic process oil.

Aliphatic hydrocarbon compounds and derivatives thereof can be used as the wax.

A so-called paraffinic wax composed mainly of a saturated aliphatic hydrocarbon compound having a molecular weight lower than 2000, preferably lower than 1000, especially preferably lower than 800, is mentioned as the aliphatic hydrocarbon compound. As specific examples of the aliphatic hydrocarbon compound, there can be mentioned n-alkanes having at least 22 carbon atoms, such as docosane, tricosane, tetracosane and triacontane, mixtures comprising an n-alkane as mentioned above as the main component and a lower n-alkane, so-called paraffin waxes and ethylene copolymer waxes, which are low-molecular-weight polymers obtained by homopolymerizing ethylene or copolymerizing ethylene with other α-olefin, waxes formed by reducing the molecular weight of polyethylene such as medium-pressure, low-pressure or high-pressure polethylene by thermal degradation, and oxidized waxes and maleic acid-modified waxes obtained by oxidizing the foregoing waxes or modifying the foregoing waxes with maleic acid.

As the aliphatic hydrocarbon compound derivative, there can be mentioned, for example, fatty acids, aliphatic alcohols, fatty acid amides, fatty acid esters, aliphatic mercaptans, aliphatic aldehydes and aliphatic ketones having at least 8 carbon atoms, preferably from 12 to 50 carbon atoms, and a molecular weight of from 130 to 2000, preferably from 200 to 800, in which at least one, preferably 1 or 2, especially preferably one functional group such as a carboxyl group, a hydroxyl group, a carbamoyl group, an ester group, a mercapto group or a carbonyl group is contained at the end or in the interior of an aliphatic hydrocarbon group such as an alkyl group or an alkenyl group.

As specific examples, there can be mentioned fatty acids such as capric acid, lauric acid, myristic acid, palmitic acid, stearic acid and oleic acid, aliphatic alcohols such as lauryl alcohol, myristyl alcohol, cetyl alcohol and stearyl alcohol, fatty acid amides such as capric amide, lauric amide, palmitic amide and stearyl amide, and fatty acid esters such as stearyl acetate.

The ultrahigh molecular weight ethylene copolymer/diluent mixing ratio varies depending upon the kinds of these components, but it is generally preferred that this mixing ratio be from 3/97 to 80/20, especially from 15/75 to 60/40. If the amount of the diluent is too small and below the above-mentioned range, the melt viscosity becomes too high and melt kneading or melt shaping is difficult, and surface roughening of the shaped article is conspicuous and breaking is often caused at the drawing step. If the amount of the diluent is too large and exceeds the above-mentioned range, melt-kneading becomes difficult and the drawability of the shaped article is insufficient.

It is generally preferred that melt kneading be carried out at a temperature of from 150° to 300° C., especially from 170° to 270° C. If melt kneading is carried out at a lower temperature, the melt viscosity is too high and melt shaping becomes difficult. If the temperature is too high and exceeds the above-mentioned range, the molecular weight of the ultrahigh molecular weight ethylene copolymer is reduced by thermal degradation and it becomes difficult to obtain a shaped article having high elastic modulus and high strength. Mixing can be performed by dry blending using a Henschel mixer or a V-blender or by melt mixing using a single screw or multiple-screw extruder.

Melt shaping of a dope comprising the copolymer and diluent is generally performed by melt extrusion. For example, filaments are obtained by melt extrusion of such a dope through a spinneret. The filaments as extruded through the spinneret may be drafted, that is, stretched in the molten state. The draft ratio can be defined by the following formula:

$$\text{draft ratio} = V/Vo$$

wherein Vo stands for the extrusion speed of the molten resin in a die orifice, and V stands for the winding speed of the cooled and solidified undrawn filaments.

While the draft ratio depends on the temperature of the mixture and the molecular weight of the ultrahigh molecular weight ethylene copolymer, it may be at least 3, preferably at least 6.

The so-obtained undrawn shaped article of the ultrahigh molecular weight ethylene copolymer is subjected to a drawing treatment. Of course, the degree of the drawing treatment is such that molecular orientation in at least one axial direction can be effectively imparted to the copolymer.

It is generally preferred that drawing of the shaped article of the ultrahigh molecular weight ethylene copolymer be carried out at a temperature of from 40° to 160° C., preferably from 80° to 145° C. Any of air, water steam and liquid media can be used as the heating medium for heating and maintaining the undrawn shaped article at the above-mentioned temperature. If a solvent capable of eluting and removing the above-mentioned diluent, which has a boiling point higher than the melting point of the composition of the shaped article, for example, decalin, decane, kerosine or the like, is used as the heating medium for the drawing operation, removal of the above-mentioned diluent becomes possible, and drawing unevenness can be eliminated at the drawing step and a high draw ratio can be attained.

Of course, the means for removing the excessive diluent from the ultrahigh molecular weight ethylene copolymer is not limited to the above-mentioned method. For example, there may be adopted a method in which the undrawn shaped article is treated with a solvent such as hexane, heptane, hot ethanol, chloroform or benzene and then drawn, and a method in which the drawn shaped article is treated with a solvent such as hexane, heptane, hot ethanol, chloroform or benzene. According to these methods, the excessive diluent can be effectively removed and a drawn product having a high elastic modulus and a high strength can be obtained.

The drawing operation may be carried out in one stage or a plurality of stages. The draw ratio depends on the desired molecular orientation and the resulting improvement of the fusion temperature, but in general, satisfactory results are obtained if the drawing operation is carried out at a draw ratio of from 5 to 80, especially from 10 to 50.

In general, drawing in a plurality of stages is advantageous, and there is preferably adopted a method in which at the first stage, the drawing operation is carried out at a relatively low temperature of from 80° to 120° C. while extracting the diluent from the extruded shaped article and at the second and subsequent stages, the operation of drawing is conducted at a temperature of from 120° to 160° C., which is higher than the drawing temperature adopted at the first stage.

Uniaxial drawing of filaments or tape is accomplished by performing the drawing operation between rollers differing in the peripheral speed.

The so-obtained molecularly oriented shaped article can be heat-treated under a restraint condition, if desired. This heat treatment is carried out at a temperature of from 140° to 170° C., especially from 150° to 175° C., for a period of from 1 to 20 minutes, especially from 3 to 10 minutes. By this heat treatment, crystallization of the oriented crystalline portion is further advanced, and the crystal fusion temperature is shifted to the high temperature side, the strength and elastic modulus are improved and the creep resistance at elevated temperatures is improved.

The rope 1 for traction according to the invention has a double structure of a core member 2 coated with a sheath member 3, in which the core member 2 comprises a molecularly oriented shaped article such as filaments and tapes of an ultrahigh molecular weight polyolefin, preferably an ultrahigh molecular weight copolymer of ethylene and at least one alpha-olefin, and the sheath member 3 comprises a braid. The core member 2 preferably comprises a bundle of aligned drawn filaments of the ultrahigh molecular weight polyolefin, or a braid made thereof. The braid may be made of a single bundle of drawn filaments. Alternatively, a number of bundles of drawn filaments, for example, 3, 4, 6 or 8 bundles of drawn filaments may be twisted together and then braided to provide the core member 2. Further, the core member may be a parallel lay rope. Depending upon the intended use and object of the rope, the diameter of the bundle of drawn filaments and the number of the bundles to be twisted together may be selected.

The core member 2, in the form of a braid, of the rope according to the invention preferably has a diameter ranging from 2 to 15 mm and a breaking energy of at least 3 kg. m/g, and in particular at least 4 kg.m/g. One of the advantages of the molecularly oriented shaped article used herein resides in the fact that braiding reduction in available strength (spinning loss) is low.

The sheath member 3 comprises a braid of yarns or strands of conventional naturally occurring or synthetic fibers. Examples of usable fibers include, for example, polyester fibers, acrylic fibers, cotton, polypropylene fibers, polyethylene fibers, polyamide fibers, rayon (viscose and cupra), linen and Vinylon fibers.

The number of yarns or strands for braiding the sheath member 3 and the thickness of the sheath member 3 may be selected depending upon the intended use of the rope. Normally, the thickness of the sheath member is preferably of the order of form 0.1 to 2 mm.

The rope according to the invention can be prepared by a double braiding method known per se. For example, during or after formation of the core member 2 by aligning or braiding a bundle or bundles of molecularly oriented filaments of an ultrahigh molecular weight polyolefin, the core member is wrapped around helically with intersecting yarns of strands so that they may be braided into an enveloping sheath member 3.

EFFECT OF THE INVENTION

The rope for traction according to the invention has a double structure of a core member coated with a sheath member, in which the core member comprises a light in weight, strong and resilient molecularly oriented shaped article of an ultrahigh molecular weight polyolefin, and the sheath member comprises a braid, and in consequence, it is floatable on water and easy to handle, and is excellent in safety to human bodies and weatherability.

EXAMPLE 1

Polymerization for Preparation of Ultrahigh Molecular Weight Ethylene/Butene-1 Copolymer Slurry polymerization for forming an ultrahigh molecular weight ethylene/butene-1 copolymer was carried out in 1 l of n-decane as a polymerization solvent in the presence of a Ziegler catalyst. A monomer mixture gas comprising ethylene and butene-1 at a molar ratio of 97.2/2.35 was continuously supplied to a reactor so that the pressure inside the reactor is kept constant at 5 kg/cm$^2$. The slurry polymerization carried out at a reaction temperature of 70° C. was completed in 2 hours.

The yield of a powdery ultrahigh molecular weight ethylene/butene-1 copolymer was 160g, an intrinsic viscosity (at 135° C. in decalin) of the copolymer was 8.2 dl/g, and the butene-1 content determined by an infraredspectrometer was 1.5 butene-1 molecules per 1000 carbon atoms.

Preparation of Drawn and Oriented product of Ultrahigh Molecular Weight Ethylene/Butene-1 Copolymer A mixture comprising 20 parts by weight of the powdery ultrahigh molecular weight ethylene/butene-1 copolymer obtained by the above-mentioned polymerization and 80 parts by weight of a paraffin wax (melting point=69° C., molecular weight=490) was melt-spun under the following conditions.

To 100 parts by weight of the above-mentioned filaments mixture was added 0.1 part by weight of 3,5-di-tert-butyl4-hydroxy-toluene as a process stabilizer. The mixture was then melt-kneaded at a set temperature of 190° C., using a screw type extruder (screw diameter=25 mm, L/D=25, manufactured and sold by Thermoplastics Co.). Subsequently, the molten mixture was melt spun through a spinning die having an orifice diameter of 2 mm, said spinning die being attached to the extruder. The extruded melt was taken at a draft ratio of 36 times with an air gap of 180 cm, cooled and solidified in the air to provide an undrawn filament. The undrawn filament was then drawn under the following conditions.

Two-staged drawing was carried out using three godet rolls. A heating medium employed in a first drawing tank was n-decane and the temperature was 110° C., and a heating medium employed in a second drawing tank was triethylene glycol and the temperature was 145° C. The effective length of each tank was 50 cm. The undrawn filament was drawn with a first godet roll operated at a rotation speed of 0.5 m/min while adjusting a rotation speed of a third godet roll to provide an oriented filament of a desired draw ratio. A rotation speed of a second godet roll was suitably selected so that a stable drawing operation is made possible. Substantially all of the paraffin wax initially added was extracted in n-decane from the filament at a stage in which it is drawn. The oriented filament was then washed with water and dried a whole day and night at room temperature and under reduced pressure, followed by determination of physical properties thereof.

Incidentally, the draw ratio was calculated from the ratio of the rotation speed between the first and third godet rolls.

Measurement of Tensile Characteristics

The oriented filament was tested for its elastic modulus and tensile strength at room temperature (23° C.) using a tensile tester (Model DCS-50M manufactured and sold by Shimadzu Seisakusho). The sample was a bundle of 100 filaments each having a thickness of 10 denier.

In that case, a sample length employed between clamps was 100 mm, and a rate of pulling employed was 100 mm/min (a rate of strain of 100%/min). The elastic modulus was an initial elastic modulus calculated from a tangential gradient of the stress-strain curve. A sectional area necessary for the calculation was obtained by calculation from a weight of the sample, assuming the density of the sample as 0.960 g/cc.

Tensile Elastic Modulus Retention and Strength Retention after Heat Hysteresis

A heat hysteresis test was carried out by allowing a sample to stand still in a gear oven (Perfect Oven manufactured and sold by Tabai Seisakusho).

The sample having a length of about 3 m was wound repeatedly on a stainless steel frame having a plurality of blocks attached to both ends thereof, and both ends of the sample were fixed. In that case, both ends of the sample were fixed to such an extent that the sample does not sag, and no positive tension was imposed on the sample. Tensile characteristics of the sample after the heat hysteresis test were determined according to the procedure as described in the aforementioned measurement of tensile characteristics.

Measurement of Creep Resistance

The drawn and oriented filament was tested for its creep resistance using a thermal stress distortion measurement apparatus (Model TMA/SS10 manufactured and sold by Seiko Denshi Kogyo), wherein the sample length was 1 cm, ambient temperature was 70° C., and measurement was conducted under an accelerated condition by applying to the sample a load corresponding to 30% of a breaking load at room temperature. In order to evaluate a creep quantitatively, the following two values were determined, That is, there were determined values of a creep elongation $CR_{90}$(%) at the time 90 seconds after application of the load, and of an average creep speed ($sec^{-1}$) between the time 90 seconds after application of the load and the time 180 seconds after the above-mentioned time.

Tensile characteristics of the bundle of drawn and oriented filaments are shown in Table 1.

TABLE 1

| Sample | Filament denier/ filaments | Draw ratio | Strength (GPa) | Elastic molulur (GPa) | Elongation (%) | Degree of orientation (F.) |
|---|---|---|---|---|---|---|
| Sample -1 | 1000/ 100 | 22.3 | 2.4 | 60 | 5.50 | 0.975 |

The inherent crystal fusion peak of the drawn and oriented filament (sample-1) of the ultrahigh molecular weight ethylene/butene-1 copolymer appeared at 126.7° C., and the proportion of fusion peak based on Tp to the total crystal fusion heat was 33.8%. The creep resistance characteristics were such that $CR_{90}$ was 3.1% and $\epsilon$ was $3.03\times10^{-5}\,sec^{-1}$. After the heat hysteresis at 170° C. for 5 minutes, the elastic modulus retention ratio was 102.2%, and the strength retention ratio was 102.5%, showing no decrease in performance of the drawn and oriented filament.

Furthermore, physical properties of this drawn and oriented filaments were such that the amount of work necessary for rupture of the filament was 10.3 kg m/g, the density was 0.973 g/cm$^3$, the dielectric constant was 2.2, the dissipation loss tangent was 0.024%, and the impulse breakdown voltage was 180 KV/mm.

A traction rope according to the present invention, which comprises the following core and sheath members was prepared.

Core Member

An eight bundle plaited rope having a thickness of 12,000 denier made of ultrahigh molecular weight ethylene/butene-1 copolymer filaments (sample-1).

Sheath Member

A sheath member was obtained by plaiting polyester spun yarns each having a thickness of 1,000 denier.

Morphological and physical properties of the rope thus prepared are shown in Table 2.

TABLE 2

| Sample | Core diameter (mm) | Wall thickness of sheath (mm) | Unit weight (g/m) | Breaking strength (Ton) | Breaking elongation (%) | Amount of energy required for bringing about breakage (kg m/g) |
|---|---|---|---|---|---|---|
| Sample -1A | 4.0 | 0.5 | 12 | 2.0 | 6.5 | 5.40 |

EXAMPLE 2

Polymerization for Preparation of Ultrahigh Molecular Weight Ethylene/Octene-1 Copolymer Slurry polymerization of ethylene was carried out in the presence of a Ziegler catalyst in 1 l of n-decane as a polymerization solvent. In that case, 125 ml of octene-1 as a comonomer and 40 Nml of hydrogen as a molecular weight-adjusting agent were collectively added, prior to the initiation of the polymerization, to the system, and the polymerization was then allowed to proceed. Ethylene gas was continuously supplied to a reactor so that the pressure inside the reactor is kept constant at 5 kg/cm$^2$ and the polymerization was completed in 2 hours at 70° C. The yield of powdery ultrahigh molecular weight ethylene/octene-1 copolymer obtained was 178 g, the intrinsic viscosity [$\eta$] (at 135° C. in decalin) was 10.66 dl/g, and the octene-1 content as determined by an infrared spectrophotometer was 0.5 octene-1 molecule per 1000 carbon atmos.

Preparation and Physical properties of Drawn and Oriented product of Ultrahigh molecular weight Ethylene/Octene-1 Copolymer Drawn and oriented filaments were prepard from the ethylene/octene-1 copolymer thus obtained in the same manner as described in Example 1. Tensile characteristics of a bundle of the drawn and oriented filaments obtained are shown in Table 3.

TABLE 3

| Sample | Filament Denier/ Filaments | Draw ratio | Strength (GPa) | Elastic molulur (GPa) | Elongation (%) | Degree of orientation (F.) |
|---|---|---|---|---|---|---|
| Sample -2 | 1000/ 100 | 16.0 | 2.3 | 65 | 5.40 | 0.978 |

The inherent crystal fusion peak of the drawn and oriented filaments (sample-2) of the ulrahigh molecular weight ethylene/octene-1 copolymer appeared at 132.1° C., and proportions of fusion heat based on Tp and $Tp_1$ to the total crystal fusion heat were 97.7% and 5%, respectively. The creep resistance characteristics of the sample-2 were such that $CR_{90}$ was 2.0% and $\epsilon$ was $9.50\times10^{-6}$ $sec^{-1}$. After heat hysteresis at 170° C. for 5 minutes, the elastic modulus retention was 108.2% and the strength retention was 102.1%. Furthermore, physical properties of the sample-2 were such that the amount of work necessary for rupture of the filament was 10.1 Kg m/g, the density was 0.971 g/cm$^3$, the dielectric constant was 2.2, the dissipation loss tangent was 0.031%, and the impulse breakdown voltage was 185 KV/mm.

A traction rope according to the present invention was obtained in the same manner as described in Example 1 using the drawn and oriented filaments (sample -2 ) of the ultrahigh molecular weight ethylene/octene-1 copolymer thus obtained. Morphological and physical properties of the rope obtained are shown in Table 4.

TABLE 4

| Sample | Core diameter (mm) | Wall thickness of sheath (mm) | Unit weight (g/m) | Breaking strength (Ton) | Breaking elongation (%) | Amount of energy required for bringing about breakage (kg · m/g) |
|---|---|---|---|---|---|---|
| Sample -2A | 4.0 | 0.5 | 12 | 2.0 | 6.3 | 5.20 |

EXAMPLE 3

A powdery mixture comprising 20 parts by weight of an ultrahigh molecular weight polyethylene (homopolymer) having an intrinsic viscosity of $[\eta]=7.42$ dl/g as measured at 135° C. in decalin and 80 parts by weight of a parrafin wax having a melting point of 69° C. and a molecular weight of 490 was melt-spun and drawn in the same manner as described in Example 1 to obtain a drawn and oriented filament. Tensile characteristics of a bundle of the drawn and oriented filaments thus obtained are shown in Table 5.

TABLE 5

| Sample | Filament denier/ filaments | Draw ratio | Strength (GPa) | Elastic molulur (GPa) | Elongation (%) | Degree of orientation (F.) |
|---|---|---|---|---|---|---|
| Sample -3 | 1000/ 100 | 23.1 | 2.5 | 90 | 4.10 | 0.980 |

The inherent crystal fusion peak of the drawn and oriented filaments (sample-3) of the ultrahigh molecular weight polyethylene was 135.1° C., and a proportion of fusion heat based on Tp to the total crystal fusion heat was 8.8%. Whereas, a proportion of fusion heat based on $Tp_1$ on the higher temperature side to the total crystal fusion heat was less than 1%. The creep resistance characteristics were such that $CR_{90}$ was 11.9% and $\epsilon$ was $1.07\times10^{-3}$ $sec^{-1}$. After heat hysteresis at 170° C. for 5 minutes, the elastic modulus retention was 80.4% and the strength retention was 78.2%. Furthermore, physical properties of the sample-3were such that the amount of work necessary for rupture of the filament was 10.2 Kg.m/g, the density was 0.985 g/cm$^3$, the dielectric constant was 2.3, the dissipation loss tangent was 0.030%, and the impulse breakdown voltage was 182 KV/mm.

A traction rope of the present invention was obtained in the same manner as described in Example 1 using the drawn and oriented filaments (sample-3) of the ultrahigh molecular weight polyethylene. Morphological and physical properties of the rope obtained are shown in Table 6.

TABLE 6

| Sample | Core diameter (mm) | Wall thickness of sheath (mm) | Unit weight (g/m) | Breaking strength (Ton) | Breaking elongation (%) | Amount of energy required for bringing about rapture (kg · m/g) |
|---|---|---|---|---|---|---|
| Sample -3A | 4.0 | 0.5 | 13 | 1.9 | 4.7 | 3.51 |

COMPARATIVE EXAMPLE 1

A traction rope was prepared using 8400 denier drawn filaments of Kebler 29 (aramid fiber produced by Du Pont) as a core in place of the core member described in Example 1. Morphological and physical properties of the rope thus obtained are shown in Table 7.

TABLE 7

| Sample | Core diameter (mm) | Wall thickness of sheath (mm) | Unit weight (g/m) | Breaking strength (Ton) | Breaking elongation (%) | Amount of energy required for bringing about rapture (kg m/g) |
|---|---|---|---|---|---|---|
| Sample -4A | 3.8 | 0.5 | 12 | 1.9 | 3.6 | 2.80 |

What is claimed is:

1. A rope for traction of a double structure of a core member coated with a sheath member, in which said core member comprises a molecularly oriented shaped article of an ultrahigh molecular weight copolymer of ethylene and at least one alpha-olefin having from 3 to 20 carbon atoms wherein said copolymer of ethylene and at least one alpha-olefin contains from 0.1 to 20 moles of copolymerized alpha-olefin on average per 1000 carbon atoms of said copolymer and has an intrinsic viscosity of at least 5 dl/g, and said sheath member comprises a braid.

2. The rope for traction according to claim 1 wherein said molecularly oriented shaped article constituting the core member comprises a bundle of aligned drawn filaments of said ultrahigh molecular weight copolymer.

3. The rope for traction according to claim 1 wherein said molecularly oriented shaped article constituting the core member comprises a braid of drawn filaments of said ultrahigh molecular weight copolymer.

4. The rope for traction according to claim 1 wherein said sheath member comprises a braid of spun yarns.

* * * * *